United States Patent [19]

Yanagisawa et al.

[11] Patent Number: 4,561,235

[45] Date of Patent: Dec. 31, 1985

[54] APPARATUS FOR AND METHOD OF PROCESSING AND PACKAGING PHOTOGRAPHIC FILM

[75] Inventors: Akira Yanagisawa, Akigawa; Hisashi Yazawa, Hino; Toshio Kato, Hachioji, all of Japan

[73] Assignee: Konishiroku Photo Industry Co., Ltd., Tokyo, Japan

[21] Appl. No.: 450,027

[22] Filed: Dec. 15, 1982

[30] Foreign Application Priority Data

Dec. 21, 1981 [JP] Japan ..... 56-207596

[51] Int. Cl.[4] ..... B65B 61/02

[52] U.S. Cl. ..... 53/411; 53/118; 53/435; 53/520; 354/307; 354/105; 355/18; 355/27; 355/58

[58] Field of Search ..... 354/105, 307, 308, 299; 355/18, 27, 56, 58; 53/118, 411, 430, 435, 520

[56] References Cited

U.S. PATENT DOCUMENTS

| | | | |
|---|---|---|---|
| 2,157,128 | 5/1939 | Hersberg | 354/307 |
| 2,909,979 | 10/1959 | Corrons | 354/308 |
| 3,545,364 | 12/1970 | Reedy et al. | 354/299 |
| 4,115,913 | 9/1978 | Moriya et al. | 53/411 |
| 4,176,939 | 12/1979 | Leuchter | 354/307 |
| 4,455,809 | 6/1984 | Dallaserra | 53/435 |

*Primary Examiner*—W. D. Bray

*Attorney, Agent, or Firm*—James E. Nilles

[57] ABSTRACT

Apparatus for and a method of processing and packaging a photographic film in which the whole process starting with preparation of a long film blank in a base magazine to the loading in a cartridge is conducted without taking any intermediate rolling step wherein the film is rolled before further processing. The film is sliced and the sliced film is continuously processed by a splicer, a printer, perforating device, sizing cutter, and rolling chute conveyor. The whole process is divided into a suitable number of steps and carried out in apparatus having intermediate partitions to form independent dark rooms or dark sections covered by a light shielding cover, so that exposure of the film can be avoided even if the other sections are illuminated.

13 Claims, 5 Drawing Figures

APPARATUS FOR AND METHOD OF PROCESSING AND PACKAGING PHOTOGRAPHIC FILM

BACKGROUND OF THE INVENTION

1. Field of the Invention

The present invention relates to apparatus for and a method of processing and packaging photographic film.

2. Description of the Prior Art

Photographic rolled films after application of emulsion are subjected to a process including successive steps such as slitting, perforating, printing of side mark including side line, printing of frame No., sizing and cutting, rolling in a cartridge, wrapping and various transportation and packaging steps until the films are put into a corrugated cardboard box. Usually, a packaging machine is provided for each of the steps, and a rolling operation wherein the film as thus far processed is rolled is conducted in each step. These machines are operated independently and the films are delivered to respective machines in accordance with the progress of the work.

More specifically, the process for 35 mm cartridge type film is as follows.

Slitting

A broad film of a base magazine is slitted into film of 35 mm wide denoted by a numeral 11 in FIG. 1, by a slitting machine.

Perforating and Printing of Side Line and Mark

Perforations 12 are formed in both longitudinal edges of the film by a perforating machine. At the same time, side marks 13 and side lines 14 are printed in the longitudinal edges of the film.

Printing of Frame No.

Frame Nos. 15 are printed in the rolling machine.

Sizing, Cutting and Winding

The film is cut in a predetermined length 21 as shown in FIG. 2. Then, after a machining of ends 22, the film is wound in a cartridge as shown in FIG. 3.

Packaging into Carton

The product is put in a resin can and is sealed in a carton together with an instruction manual.

Packaging for Transportation

Ten cartons are wrapped by cellophane to form a package. Suitable number of packages, typically between 100 and 200, are sealed in a corrugated cardboard box.

In the process explained above, the packaging into carton and packaging for transportation can be made in an illuminated place. However, the steps down to rolling into the cartridge has to be made in darkness because the film would be exposed. It is, therefore, necessary to conduct these steps keeping the working place dark by a light shielding cover or the like. As a result, the working conditions are extremely bad. It is quite disadvantageous if different steps are conducted by independent machines such as a cutting machine, a perforating machine, a rolling machine and so forth under such bad working conditions. For instance, the number of stocks or number of films in the process needs to be increased and requires a large stock space.

In addition, the clerical managing work such as delivery of the films from one to another machine, as well as the labor load due to repeated attaching and detaching of the film to and from these machines in the darkness, is increased inconveniently.

SUMMARY OF THE INVENTION

Accordingly, an object of the invention is to provide apparatus and a processing and packaging method in which the machines sharing those steps carried out in the darkness are combined to simplify the process and to eliminate the transfer of the film, usually in rolls, between the machines, thereby to make it possible to complete process by one manual step of attaching and detaching the slit roll film to and from the magazine. According to this method, it is possible to minimize the manual labor involved and to permit the apparatus as a whole to be covered by a light shielding cover, thereby to enable the work to be carried out in a bright room to improve working conditions. Therefore, according to the invention, there is provided a method of processing and packaging photographic film and apparatus for accomplishing the method in which a series of processing steps starting with the preparation of the long film blank in the magazine and rolling the film in the cartridge is carried out continuously by making use of successive machines such as a splicer, perforating machine, printer, cutter, rolling chute conveyor and so forth.

Other objects and features of the invention will become clear from the following description of the preferred embodiment taken in conjunction with the accompanying drawings.

DESCRIPTION OF THE PREFERRED EMBODIMENTS

A preferred embodiment of the invention will be described hereinunder with reference to the accompanying drawings.

Figure 4:
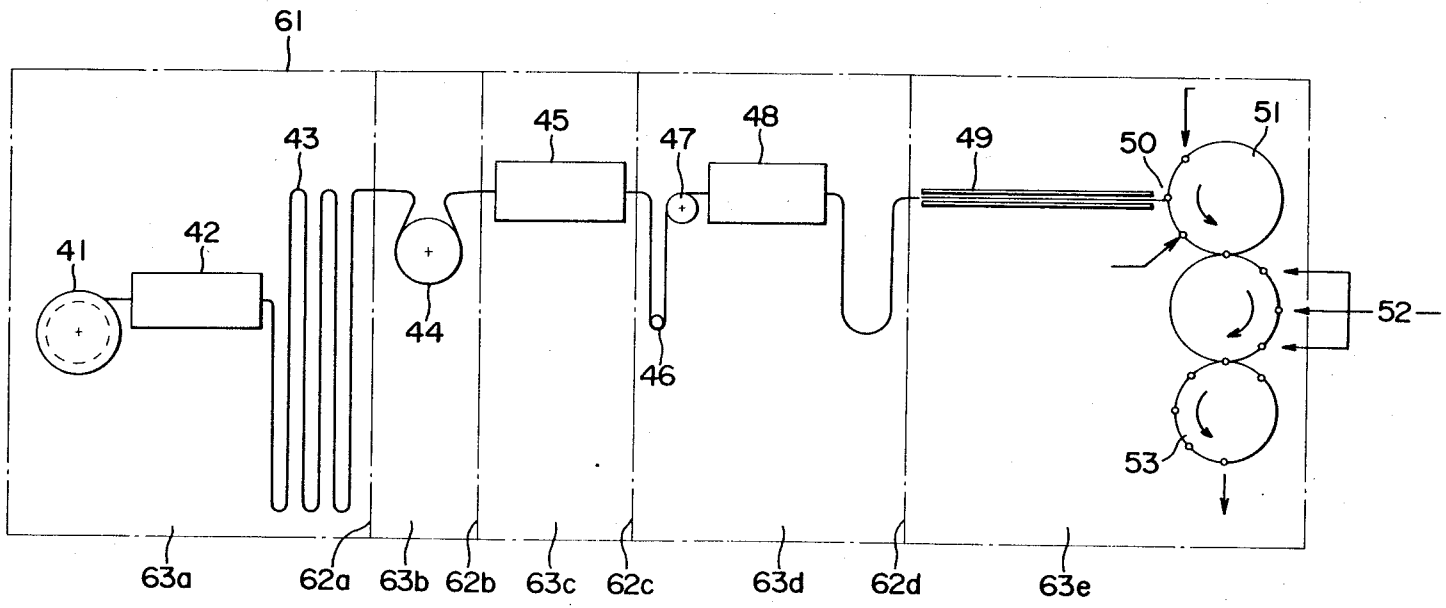
FIG. 4 shows an arrangement and apparatus in accordance with an embodiment of the invention.

Referring first to FIG. 4 which shows an arrangement and apparatus in accordance with one embodiment of the invention, a 35 mm blank film, which has been slitted by a slitter but not perforated yet, is loaded in a slit roll magazine 41. In this embodiment, a long film blank obtained by slitting a broad film into film webs 35 mm wide is loaded in the slit roll magazine 41. The slit roll magazine 41, which is a light-shielding magazine, is loaded with the film blank in a dark place. A plurality of magazines thus loaded are set in a magazine rack in an illuminated place. Data such as magazine Nos., lot numbers of film and so forth are presented by a bar code or the like on the surface of the magazine 41. As the magazines are set in place, these data are read automatically and utilized as production managing information.

After the completion of unrolling of the film web out of the slit roll magazine 41 in use, another film web is extracted from the next slit roll magazine 41 and the leading end of the new film web is automatically joined or spliced to the trailing end of the old film web by a splicer 42.

An accumulator 43 provided in the joint portion 63*a* is intended for preparing film stock for continuously operating the perforating machine 44 and other machines for steps following perforation, even during the splicing of the old and new film webs by the splicer 42.

Figure 1:
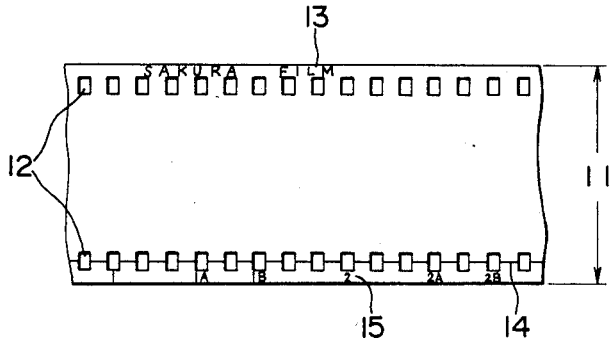
FIG. 1 shows a 35 mm photographic film.

The film web which is continuously supplied from the accumulator 43 is perforated along both its longitudinal edges as at 12 (see FIG. 1) by the perforating machine 44. For related operation with other steps, the perforating machine 44 is required to have a capacity which meets the capacity of other machines, particularly to meet the film consumption demanded by a latermentioned rolling machine. Such a requirement can never be fulfilled by conventional reciprocal perforating machines. However, a rotary continuous perforating machine as shown in Japanese Patent Laid-open No. 44,583/75 well meets this demand.

Then, various printing steps are performed by a printer 45 which may be one of the devices as proposed in Japanese Patent Laid-open No. 83,730/81 or Japanese Utility Model Laid-open No. 38,341/81.

Figure 2:
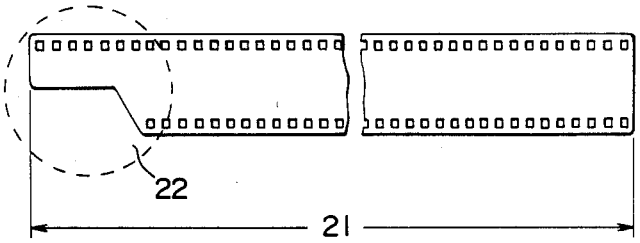
FIG. 2 shows a 35 mm photographic film cut in a predetermined length.
Figure 3:
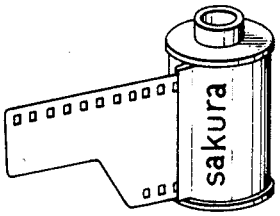
FIG. 3 shows a cartridge.

The film web which has passed continuously through the perforating machine 44 and the printer 45 is fed intermittently by means of the operation of the dancer roller or accumulator 46, and is transferred to the sizing and cutting operation conducted by a metering device 47 and a cutter 48. The film which has been cut in lengths of a predetermined size as shown in FIG. 2 is taken up and rolled on a spool by a rolling chute conveyor 49 and a rolling head 50, and is stored in the cartridge by a cartridge capping turret 51. For instance, as shown in the specification of Japanese Patent Laid-open No. 70,248/81, the film cut in the predetermined length is inserted into a chute which is adapted to move at a right angle to the direction of movement of the film, and the lengths of film are traversed one by one. The lengths of film in the thus-traversed chute are continuously rolled in the cartridges. The cartridges are successively supplied to the end of the chute.

The total number of the thus loaded cartridges is automatically checked by an automatic checker 52, and the cartridges are put in cans by a known can loading device 53 into a half-finished product suitable for handling.

As has been described, according to the invention, the film processing and packaging process, which has been carried out hitherto in a disjointed fashion employing various machines which operate independently, is combined into one automatic machine or apparatus with the aid of the accumulator 43 and the dancer roll 46 working in suitable portions of the process, and the processing and packaging of the film can be made continuously under the control of a controller, even if respective steps require different times. The invention, therefore, offers the following advantages.

(i) Reduction in the intermediate stock under processing.

(ii) Shortening of the time of passage of the film through the process.

(iii) Simplification of work required for delivery of the product and elimination of the work of transferring the film between two adjacent sections or machines.

(iv) Reduction in the number of workers.

Thus, the invention offers a remarkable improvement in productivity.

Figure 5:
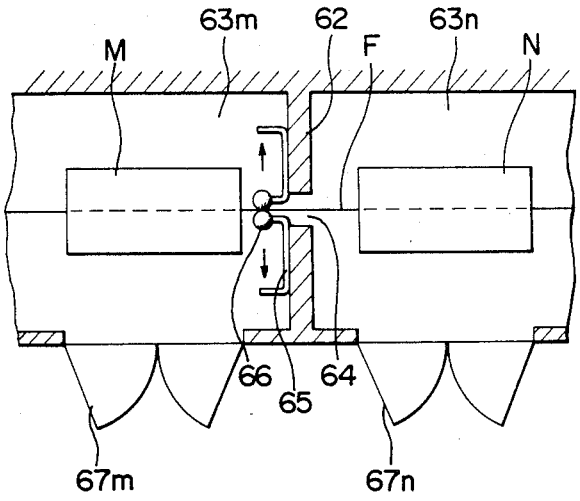
FIG. 5 shows an arrangement and a portion of apparatus in accordance with the invention having an intermediate partition between adjacent sections in which processing steps are carried out.

In the described embodiment, the whole process is suitably divided into steps carried out in a plurality of stages, some accomplished in sections or chambers which are separated by intermediate partitions so that some stages occur in a dark room or chamber covered by a light-shielding cover, while other stages occur in an illuminated room, so that the film in a stage in a dark room or under a light shielding cover is not exposed. More specifically, as FIG. 4 shows, a light-shielding cover 61 is used to cover the whole apparatus starting from the splicer 42 and the can loading device 53, so that the apparatus as a whole can be operated in an illuminated place. In addition, as FIGS. 4 and 5 show, intermediate partitions 62*a*, 62*b*, . . . 62*d* are provided to separate major stages. By so doing, it becomes possible to accomplish necessary maintenance work by opening a suitable light shielding door 67*m*, 67*n*, for example, in the event of trouble or failure in a specific portion of the apparatus. This also protects the film web in other sections against exposure.

FIGS. 4 and 5 show the arrangement of the light shielding cover 61 and the intermediate partitions 62*a* . . . 62*d*. As FIG. 5 shows, the space is sectioned by the partition wall 62 into small rooms or chambers 63*m*, 63*n* in which processing and packaging sections M and N wherein operations on the film are performed. To this end, a window or aperture 64 constituting an access opening for fim web F is formed in the partition wall 62. A slide shutter means 65 comprised of two halves or members opposing each other is provided for the window 64. A rotary roller 66 made of black sponge which is resilient and opaque is provided at the end of each member of the slide shutter 65. The small rooms or chambers 63*m*, 63*n* are provided with doors 67*m*, 67*n*, respectively. In operation, a film web F is moved between the sections M and N through the small window 64. In particular, the slide shutter 65 is moved and retracted in the direction of the arrows in FIG. 5 to open the window 64 so that the film web F is directly stretched between the devices in sections M and N. At the same time, the doors 67*m* and 67*n* are closed to permit the small rooms 63*m* and 63*n* to be unilluminated and used as dark rooms.

Assuming now that minor trouble has occurred in a film processing and packaging device in section N, the slide shutter 65 is closed and the film web F is pinched or engaged from both sides thereof by rollers 66 to separate the small rooms or chambers 63*m* and 63*n* to provide a light-tight shield therebetween. Then the repair work is conducted by opening the door 67*n*. At this time, the film web F in the small room or chamber 63*n* is exposed but the film in the small room or chamber 63*m* is never affected.

When the film web F is reset on the apparatus after the completion of the repair work stated above, or when the film of a predetermined length is extracted from the small room or chamber 63*m* to the small room 63*n*, the web F can be moved smoothly without being damaged, as two opposing rollers pinching the film web therebetween are made to rotate.

As has been described, according to the invention, it is possible to place the apparatus as a whole in an illuminated room provided that a light shielding cover such as 61 is applied thereto to permit a remarkable improvement in working conditions.

What is claimed is:

1. A method of automatically processing and loading photographic film in a cartridge comprising the steps of:
providing a pair of film webs having a tail end of one and a leading end of the other;
advancing the film webs along a path;
accumulating a portion of said one film web along said path;
and momentarily stopping the advance of and splicing the ends of said film webs while continuing to advance the remainder of said one film web along said path and while performing processing operations thereon.

2. A method according to claim 1 wherein said processing operations include the step of perforating said on film web.

3. A method according to claim 2 wherein said processing operations include the step of printing on said one film web.

4. A method according to claim 1 or 2 or 3 wherein said processing operations include the step of cutting a predetermined length from said one film web after said length has been perforated and printed.

5. A method according to claim 4 wherein said processing operations include the step of inserting said predetermined length cut from said one web into a cartridge.

6. A method of processing and packaging photographic film comprising the steps of:
providing a plurality of roll magazines, each of which contains a web of film, each film web having a leading end and a trailing end;
providing a splicer in which the trailing end of one film web is to be joined to the leading end of another film;
continuously advancing a first portion of one film web along a path while continuously performing operations thereon;
continuously accumulating a second portion of said one film web intermediate its ends;
advancing another film web along said path while said first portion of said one film web is still advancing for joining the leading end of said other film web and the trailing end of said one film web;
and momentarily stopping the advance of said leading end of said other film web and the advance of said trailing end of said one film web and effecting splicing of said ends while they are stopped and while at least said first portion of said one film web continues to advance.

7. Apparatus for automatically processing and loading photographic film in a cartridge comprising the steps of:
means for providing a pair of film webs having a tail end of one and a leading end of the other;
means for advancing said film webs along a path;
means for accumulating a portion of said one film web along said path;
means for performing processing operations on said one film;
and means for momentarily stopping the advance of and
splicing the ends of said film web while continuing to advance the remainder of said one film web along said path and while performing processing operations thereon.

8. Apparatus according to claim 7 wherein said means for performing processing operations includes means for perforating said one film web.

9. Apparatus according to claim 8 wherein said means for performing processing operations includes means for printing on said one film web.

10. Apparatus according to claim 7 or 8 or 9 wherein said means for performing processing operations includes means for cutting a predetermined length from said one film web after said length has been perforated and printed.

11. Apparatus according to claim 10 wherein said means for performing processing operations includes means for inserting said predetermined length cut from said one web into a cartridge.

12. Apparatus for processing and packaging photographic film in a cartridge comprising:
a plurality of roll magazines, each of which contains a web of film, each film web having a leading end and a trailing end;
a splicer in which the trailing end of one film web is to be joined to the leading end of another film;
means for continuously advancing a first portion of one film web from one of said roll magazines along a path;
means for continuously performing operations on said first portion of said one film web;
accumulator means for continuously accumulating a second portion of said one film web intermediate its ends;
means for advancing another film web from another of said roll magazines along said path while said first portion of said one film web is still advancing for joining the leading end of said other film web and the trailing end of said one film web;
and means for momentarily stopping the advance of said leading end of said other film web and the advance of said trailing end of said one film web and effecting splicing of said ends while they are stopped and while at least said first portion of said one film web continues to advance.

13. An automatic photographic film loading apparatus in a cartridge comprising:
(a) a plurality of roll magazines (41) for loading a web of slitted film,
(b) a splicer (42) for jointing a trailing end of a preceding film web to a leading end of a subsequent film web extracted from the roll magazine (41),
(c) a first accumulator (43) disposed between the splicer (42) and a perforating means (44), and preparing film stock for continuously supplying the film to the perforating means (44) during the jointing of the film by the splicer (42),
(d) the perforating means (44) for perforating both longitudinal edges of the film from the first accumulator,
(e) a printing means (45) for printing the film from the perforating means,
(f) a sizing cutter (48) for cutting the film in predetermined size,
(g) a second accumulator (46) disposed between the printing means (45) and the sizing cutter (48) for supplying the film which is continuously conveyed from the printing means (45) to the cutter (48) intermittently in accordance with intermittent cutting behavior of the cutter (47, 48), and
(h) a chute conveyor (49) for packaging the cut film from the second accumulator (46) in a cartridge.

* * * * *